US005730370A

United States Patent [19]

Bowen

[11] Patent Number: 5,730,370

[45] Date of Patent: Mar. 24, 1998

[54] LEAK RESISTANT NOZZLE BALL

[75] Inventor: Norman D. Bowen, Etobicoke, Canada

[73] Assignee: Bex Engineering Ltd., Mississauga, Canada

[21] Appl. No.: 751,533

[22] Filed: Nov. 14, 1996

[51] Int. Cl.[6] ..... B05B 15/08

[52] U.S. Cl. ..... 239/587.3; 239/587.4; 285/261

[58] Field of Search ..... 239/587.3, 587.4, 239/600; 285/261, 322, 328, 382

[56] References Cited

U.S. PATENT DOCUMENTS

| | | | |
|---|---|---|---|
| 664,291 | 12/1900 | Reniff | 285/261 X |
| 1,099,220 | 6/1914 | Ward | 285/261 X |
| 1,730,348 | 10/1929 | Anstiss | 239/587.4 |
| 3,612,408 | 10/1971 | Holleman | 239/587.3 |
| 3,985,303 | 10/1976 | Steimle | 239/587.4 X |
| 4,919,338 | 4/1990 | Junk | 239/587.4 |
| 4,961,597 | 10/1990 | Bowen . | |
| 5,257,739 | 11/1993 | Pascaru | 239/587.3 X |
| 5,449,206 | 9/1995 | Lockwood | 285/261 |

*Primary Examiner*—Andres Kashnikow
*Assistant Examiner*—Steven J. Ganey
*Attorney, Agent, or Firm*—Bereskin & Parr

[57] ABSTRACT

A spray nozzle assembly has a main nozzle body defining a socket having a part-spherical surface. A nozzle ball is mounted within the nozzle socket and, in known manner a collar or the like is used to secure the ball in position. To provide an adequate seal between the nozzle ball and the nozzle body, a sealing lip is provided on the nozzle ball. This lip extends radially outwardly beyond the nozzle ball. The lip can be in the form of a cone tangential with the spherical surface. This sealing configuration can be used for other purposes, and is generally applicable to providing a connection between two fluid conduits, which are required to meet at an angle that is adjustable.

18 Claims, 3 Drawing Sheets

LEAK RESISTANT NOZZLE BALL

FIELD OF THE INVENTION

This invention relates to fluid connections provided by a ball and socket joint. This invention is more particularly concerned with the sealing of such a joint.

The invention will be described with particular reference to use with spray nozzles, but is not limited to such applications and has general applicability to any such fluid connection.

BACKGROUND OF THE INVENTION

Spray nozzles are utilized in many areas where a spray of liquid is required: metal washing, foam control, asphalt spraying, vehicle washing, and dishwashers, to name but a few. In metal washing, a popular form of spray nozzles is the adjustable ball clip-on spray nozzle. The nozzle may be mounted on a tubular header which has been drilled to provide a communicating hole. The nozzle comprises a body with a hemispherical socket for accommodating a nozzle ball and a nozzle ball, which is retained in the socket by a collar which engages external screw thread on the body. The body is provided with a spigot for extending into the header hole. A passageway extends through body to a chamber which is between the socket and the nozzle ball. The chamber is in flow communication with a central cavity in the nozzle ball and the cavity extends to a nozzle spray outlet.

In use, fluids such as water, paint, or other coating materials are forced through the header, through the spigot, through the passageway, through the chamber, through the cavity of the nozzle ball, and out the nozzle spray outlet. The fluid may be at high pressure.

It is to be appreciated that this ball and socket is applicable to any fluid conduit, and has the great advantage that it is infinitely adjustable through a wide range of angles.

Tightening the collar is intended to press the nozzle ball against the body sufficiently to prevent leakage. Complementary sizing and shaping of socket and the nozzle ball allow the direction of spray to be adjusted by rotating the nozzle ball. To allow the nozzle ball to be adjusted, the seal between the socket and the nozzle ball cannot be made by means of, for example, an adhesive or caulking compound. Hence, to prevent leakage between the ball and the socket, both parts should ideally be made to very close dimensional tolerances. If the components are machined from metal, reasonably tight tolerances can be obtained, and suitable metals or other materials are strong enough to maintain their dimensions under pressure. However, machining the components from metal is very costly. Alternatively, if the assembly is made of a rigid material, a separate gasket, packing or seal may be used, but such a seal would necessarily restrict the adjustment of the nozzle ball.

Plastic is the preferred material because of the economy of injection moulding the components. However, if the nozzle ball and the body are made of injection moulded plastic, the close tolerances on sphericity and diameter of the nozzle ball and socket cannot be maintained because of the uneven cooling of the parts and subsequent non-uniform shrinkage during moulding. Shrinkage is related to wall thickness, moulding pressure and cooling rate. Many plastics typically shrink by the order of 7%, with thicker parts shrinking the most. Consequently, the dimensions of the plastic components vary from piece to piece, causing an imperfect fit, and leakage between the nozzle ball and the nozzle body.

If the components are sufficiently rigid, a separate gasket, packing or seal can be used, but this has disadvantages. It may limit the angle of movement of the nozzle ball. If the ball is moved too far, a lip, between the outside of the ball and an internal bore, can snag such a seal and damage it. Such a gasket or the like adds to the complexity and cost.

Leakage problems are worsened when the nozzle spray is used at relatively high pressures. The high pressure of fluid from the header may force the fluid into interstices between the nozzle ball surface and the socket further deforming the assembly.

Leakage between the nozzle ball and the socket results in a loss of pressure and a loss of fluids which would otherwise be directed through the spray outlet. In addition, where fluids being are used, such as paint or phosphates which solidify in use, fluids can accumulate between the nozzle ball and the socket may result in an adhesion between the nozzle ball and socket, thus preventing the redirection of the spray outlet.

SUMMARY OF THE INVENTION

In accordance with the present invention, there is provided a nozzle ball for use in a spray nozzle, the nozzle ball comprising: a main body having a substantially spherical surface; a spray outlet in the nozzle ball; an inlet aperture in the nozzle ball; a cavity in the nozzle ball providing flow communication between the inlet aperture and the spray outlet; and a sealing lip on the main body, the sealing lip extending around the inlet aperture and extending radially outwardly beyond the spherical surface, whereby in use, when mounted in a socket having a spherical surface complementary to the spherical surface of the main body, the sealing lip can be pressed against the spherical surface of the socket to form a seal.

The sealing lip extends radially outwards away from the center of the spherical surface. It can take many forms. Preferably, the nozzle ball includes an axis, extending through the center of the spherical surface of the main body, with the spray outlet and the aperture co-axial with the axis and the sealing lip including a circular sealing edge coaxial with the axis. More preferably, the sealing lip includes an outer surface, e.g. a conical surface, tangential with the spherical surface of the nozzle ball, so as to minimise the number of edges that can become caught as the nozzle is adjusted. The sealing lip may also comprise a simple annular projection.

In accordance with another aspect of the present invention, there is provided a spray nozzle assembly comprising:

a nozzle ball which comprises a main body having a substantially spherical surface, a spray outlet in the nozzle ball, an inlet aperture in the main body, a cavity in the nozzle ball providing flow communication between the inlet aperture and the spray outlet, and a sealing lip on the main body, the sealing lip extending around the aperture and extending radially outwardly beyond the spherical surface;

a nozzle body defining a part-spherical socket, which is open at one end of the nozzle body, and a passageway extending from the socket to the other end of the nozzle body, the socket including a part-spherical surface complementary to the spherical surface of the nozzle ball, wherein the nozzle body includes a first coupling formation; and locking means including a second coupling formation, adapted to engage the first coupling formation, so as to secure the nozzle ball within the socket and to press the nozzle ball into the nozzle socket, whereby the sealing lip of the nozzle ball is pressed against the socket to form a seal.

The nozzle ball of this aspect of the invention can include all the features of the nozzle ball outlined above. The present invention is particularly applicable to nozzle assemblies formed from plastic, as most plastics suffer from significant shrinkage during moulding, making it difficult to maintain the tight tolerances necessary for forming a seal in conventional designs.

Accordingly, the nozzle ball, the nozzle body and the locking means can be integrally moulded from a plastic material. The nozzle ball, the nozzle body and the locking means are preferably integrally moulded from glass reinforced polypropylene.

A further aspect of the present invention is based on the realization that the invention has general applicability to forming a connection between any two fluid conduits where it is necessary to form a good seal and to permit any desired angle to be provided between the two conduits. This aspect of the invention provides a fluid connection device, for providing fluid communication between two fluid conduits, the device comprising:

a first member defining a socket open at one end of the fluid member, and a connection port extending from the socket and open at the other end of the fluid member, the socket defining a part-spherical surface;

a second fluid member including a main body having a spherical outer surface complementary to the spherical surface of the socket, an aperture in the socket, a second communication port and a cavity within the second member extending between the second communication port and the aperture, and a sealing lip around the aperture and extending radially outwardly beyond the spherical surface of the second fluid member; and engagement means, engagable with the first fluid member, for maintaining the second fluid member within the socket and for pressing the sealing lip of the second fluid member against the socket to form a seal. Again all the other variations of the other aspects of the invention are applicable to this aspect of the invention.

BRIEF DESCRIPTION OF THE DRAWINGS

For a better understanding of the present invention and to show more clearly how it may be carried into effect, reference will now be made, by way of example to the accompanying drawings which show a preferred embodiment of the present invention and in which.

DESCRIPTION OF THE PREFERRED EMBODIMENT

Figure 1:
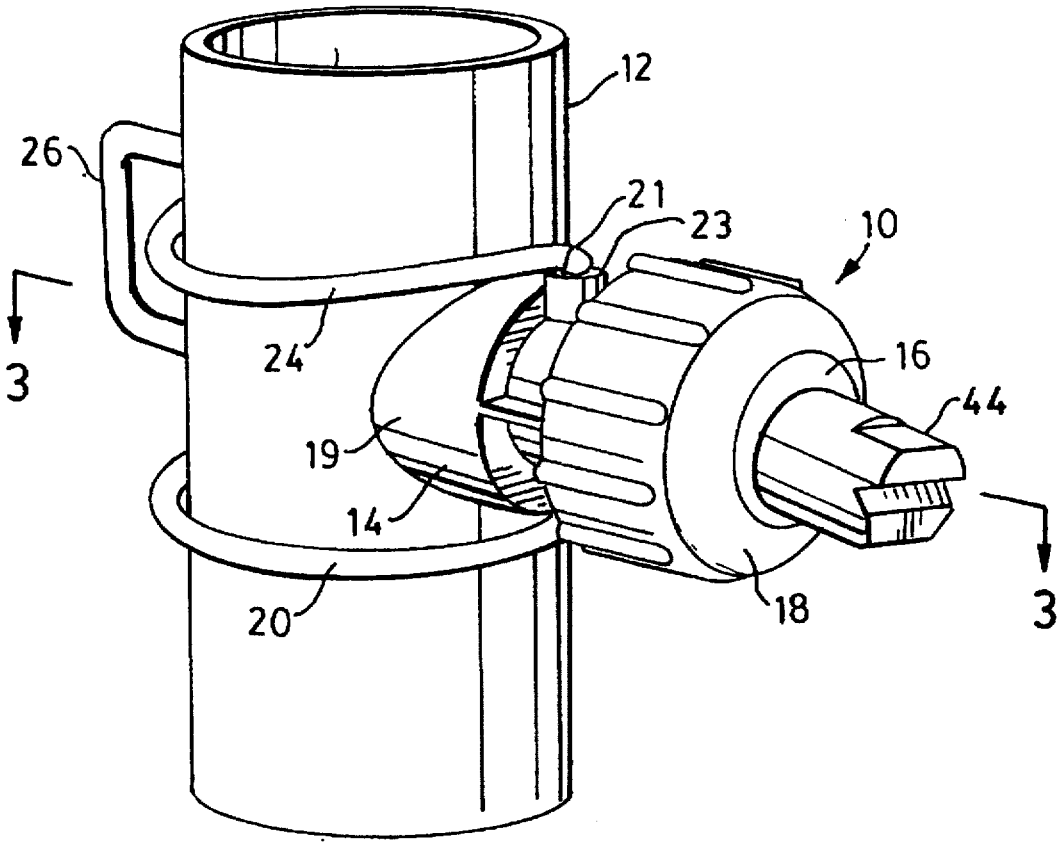
FIG. 1 is a perspective view of an adjustable ball spray nozzle mounted on a cylindrical header in accordance with the present invention.

Reference is first made to FIG. 1 of the drawings, which is a perspective view of an adjustable ball spray nozzle 10 mounted on a cylindrical pipe header 12. This form of nozzle will be used as an exemplary application for the ball spray nozzle of the present invention and therefore a detailed description of the nozzle ball of the invention will be preceded by brief description of a typical nozzle 10.

Figure 2:
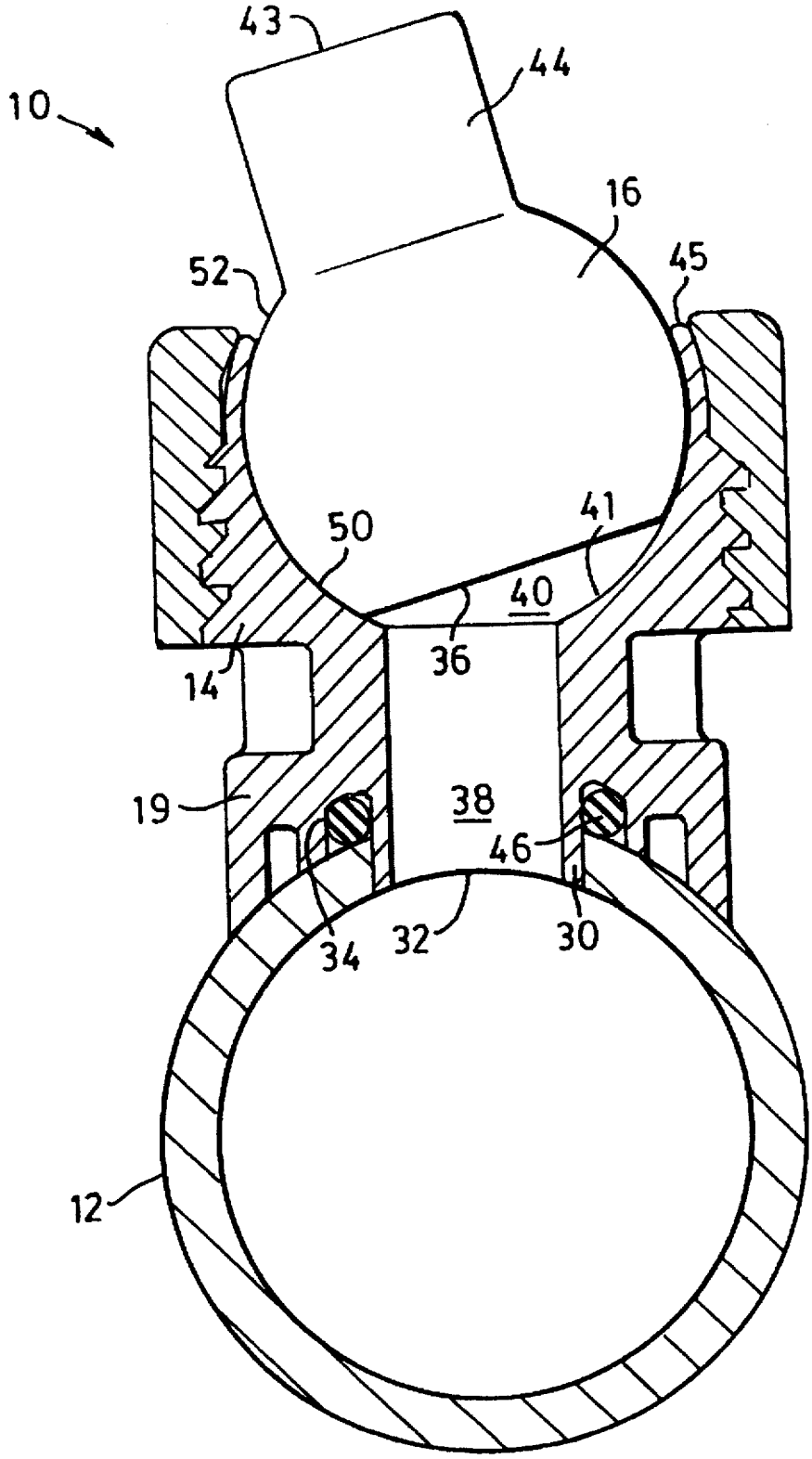
FIG. 2 is a sectional view corresponding to a view along line 3—3 of FIG. 1 and showing a prior art sealing ring.

As shown in FIG. 2, a nozzle 10 comprises a body 14 having a through-passage 38 in communication with the interior of the header 12 and a nozzle ball 16, rotatably mounted on the body 14 and retained on the body 14 by a collar 18 which engages an external screw thread on the body 14. The body 14 has a base portion 19 which defines a saddle-like shape conforming to the external surface of the header. The components of the nozzle 10 are formed of a suitable material such as plastic, stainless steel or other rigid material. A particularly suitable material is glass-reinforced polypropylene.

A spring clip 20 is pivotally mounted on the body 14 for releasably retaining nozzle 10 on header 12. Clip 20 is formed of a length of spring wire having two inwardly directed ends 21 (only one visible in FIG. 1) which engage recesses 23 on body 14, a part circular header engaging portion 24 and an outwardly directed portion 26 which an operator may use to release clip 20 from header 12. The header engaging portion extends through slightly more than a semicircle, so as to provide an over center type action, to secure the nozzle in position.

Referring now to FIG. 2 of the drawings, which shows a cross section of the spray nozzle, a spigot 30 extends from body 14 of nozzle 10 into a bore 32 provided in header 12. Surrounding the spigot 30 is a groove 34 for receiving a sealing member. The sealing member is in the form of an O-ring 46. The passageway 38 extends through the spigot 30 and into a chamber 40. The chamber 40 is defined by the space between a substantially hemispherical socket 41 and the nozzle ball 16. This nozzle ball 16 is intended to be of complementary shape to socket 41 and rotatable therein and is provided with a cavity 42 (FIG. 3) for flow communication with the chamber 40 throughout the range of movement possible for nozzle ball 16. A nozzle spray outlet 43 is in flow communication with the cavity 42. The spray outlet 43 is formed in a cylindrical post 44 which extends from and is integral with the nozzle ball 16, outwards through collar 18. The spray outlet 43 is provided with a particular configuration, depending on the form of spray required.

The socket 41 is generally spherical and comprises a bottom part that is a hemisphere. This continues into a top part defined by a series of fingers 45 separated by suitable gaps **45*a*. These fingers 45 serve three major functions. Firstly, they are resilient enough, to spread apart to permit the ball 16 to be inserted. Secondly, in use, they prevent direct contact between the collar 18 and the ball 16, so that, as the collar 18 is tightened, a preset position for a ball 16 is not disturbed. Thirdly, they deflect inwards, to enable the collar 18 to apply an axial load to the ball 16 pressing it downwards, as shown in the Figures, with the intention of sealing the ball to the socket 41**.

In use, the nozzle 10 is subject to a pressure from a pressurized fluid from the header. With significant pressure, it has been found that the forces acting on the nozzle may be such that integrity of the seal between nozzle ball 16 and socket 41 is affected, leading to leakage of fluid between nozzle ball 16 and socket 41. Additionally, as noted above, poor tolerances in manufacture may make it difficult to achieve a satisfactory seal. Here, at least part of the problem is that the inherent rounded shape of the ball and socket distribute any axial load over a large area; i.e. there is no distinct sealing surface which is subject to a high sealing pressure to form an adequate seal.

Figure 3:
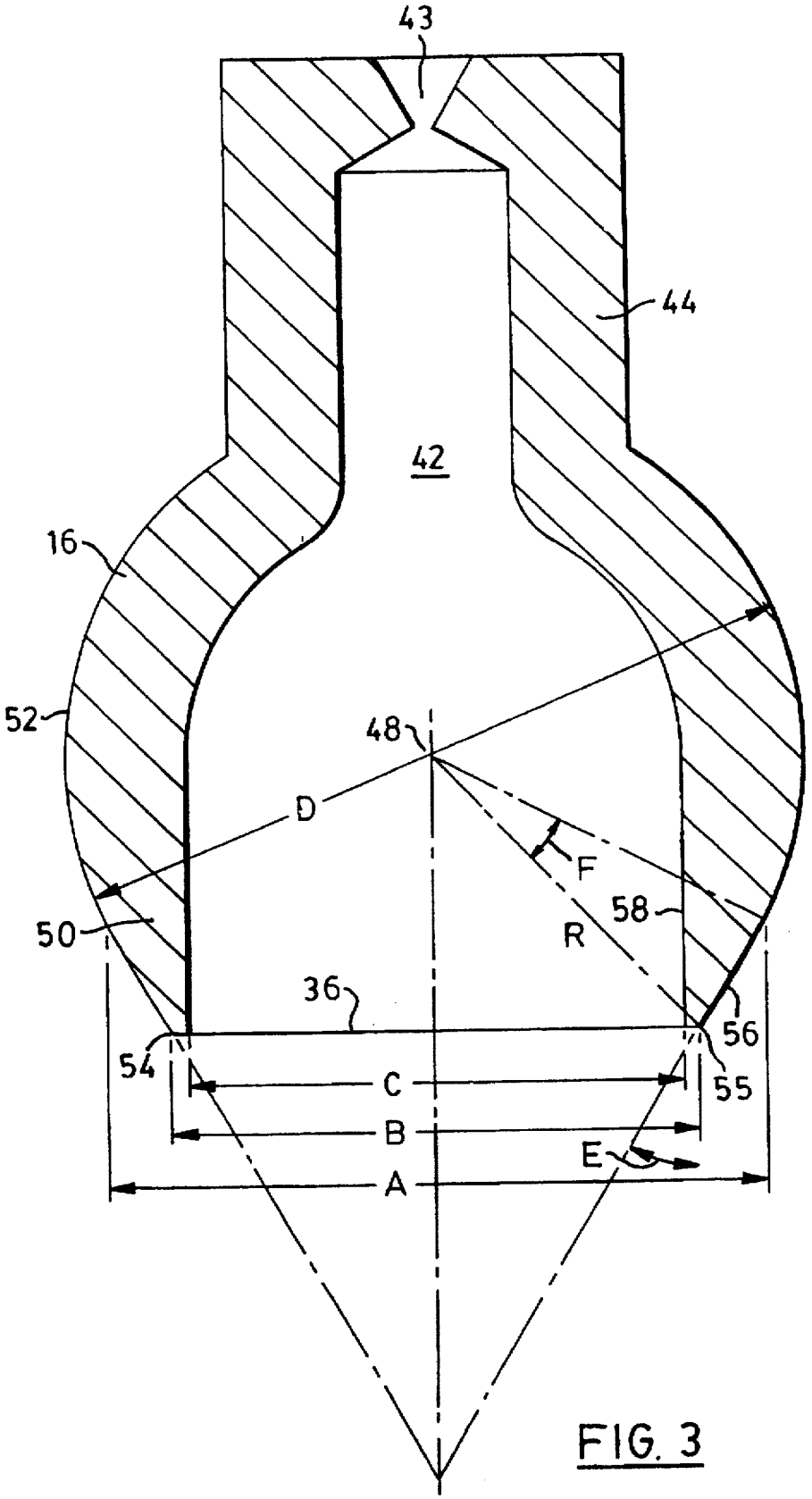
FIG. 3 is a partial sectional view along line 3—3 of FIG. 1 and showing details of the nozzle ball of the spray nozzle of present invention.

FIG. 3 of the drawings illustrate a nozzle ball 16 in accordance with the preferred embodiment of the present invention. Like conventional nozzle balls, the nozzle ball 16 comprises a main body having a substantially spherical surface 52, a cylindrical post 44, a spray outlet 43, a cavity 42, and an aperture 36. However, in accordance with the present invention the ball 16 is provided with a lip 50. The cavity 42 is in flow communication with an inlet aperture 36 and with the spray outlet 43.

The lip 50 comprises an outer surface 56 and an inner surface 58, and chamfered end surface 54. The inner surface 58 defines part of the cavity 42, and the outer surface 56 is conical and tangential to the spherical surface 52. Hence, the lip 50 forms a cone-like structure around and coaxial with the aperture 36. The lip 50 need not be perfectly conical and can comprise other profiles. The lip 50 encircles the aperture 36. The chamfered end surface 54 has a sealing edge 55, where it joins the outer surface 56.

In this embodiment, the conical outer surface has a cone generating angle indicated at E. The angular extent of the surface 56 is indicated by the angle F. The external and internal diameters of the outer surface 56, as measured in planes perpendicular to the axis of the nozzle ball 16 are indicated at A and B. The inlet aperture 36, adjacent the lip 50 has a diameter indicated at C. It will be appreciated that the radial difference between the diameters B and C is equal to the width of the chamfered end surface 54. The main diameter of the ball 16, throughout center 48 is indicated at D.

In view of the fact that the conical outer surface 56 is tangential to the main cylindrical portion of the ball 16, the sealing edge 55 is located on a radius R which is greater than the radius of the ball 16 itself. This is such that this edge 55 will form a tight seal with a socket, as detailed below.

Thus, what is essential to the invention is the provision of a sealing edge 55, or surface, which projects radially outwardly from the ball 16 and presents a sufficiently small surface area that sufficient pressure can be generated between it and a socket, to form a seal. Thus, instead of an edge, an annular surface with some measurable width could be provided. It will also be realised that the conical profile of the surface 56 is not essential. Thus the ball 16 could be wholly conventional except for a raised annular lip around the aperture 36, the lip extending either parallel to the main axis of the ball 16, or radially outwardly from its center 48. As depicted in FIG. 3, the edge 55 is preferably a sharp edge.

While the nozzle ball preferably has a cylindrical post 44, as depicted in FIG. 1 and 2, this is not essential to the invention, as described.

In use, when the ball 16 is pressed into socket 41 by screwing down of collar 18, the edge 55 of lip 50 deforms and also generates a relatively high local stress forming a tight seal with socket 41. Either one or both of the lip 50 and the nozzle body 14 are sufficiently resilient to deform sufficiently to form a good seal. This resiliency also ensures that, even if the ball 16 is not a perfect fit with socket 41 when unloaded, a good seal can still be formed. Thus, as the collar 18 is tightened on the thread, it imposes a force on ball 16, pushing ball 16, including lip 50, against socket 41. This forms a tight, leak resistant seal. As seen in FIG. 2, it is preferred that the entire lip 50 is in contact with the socket 41, for all angles of the ball 16.

The socket 41 is preferably more resistant to deformation than the lip 50. At least when all component are formed from the same material, e.g. glass-filled polypropylene, the socket 41 will inherently be more resilient to deformation, due to the different wall thicknesses. Hence, the lip 50 is deformed inward when force is applied to the ball 16, as described above. As the socket 41 is substantially hemispherical, this causes the lip 50 to assume a less conical and more spherical shape, complementary to the socket 41. To adjust the position of the ball 16, the fingers 45 are sufficiently resilient, to enable the nozzle 16 to be adjusted easily.

For sealing to occur at high fluid pressures, the socket 41 is substantially less flexible than the lip 50, as above. Thus, at high fluid pressures the hoop stress on the inner surface 58 causes the thin end of the conical section of the ball to expand to further conform to the socket 41, thereby sealing even more tightly.

Thus it can be seen that the nozzle described above provides an effective seal between the nozzle ball 16 and the socket 41. Furthermore, when used under high pressure, the force applied to the inner surface 58 by the fluids presses lip 50 further tightly against the socket 41, thus increasing the effectiveness of the seal. At the same time, the use of the present invention, does not significantly restrict the ability to redirect the spray from the spray outlet 43 by rotation of the ball 16.

In this particular example, the various dimensions of a suitable nozzle ball 16 are set out below and correspond to the dimensions: A, the diameter of nozzle ball 16 at the point at which the tangent line defining the outer surface 56 meets the spherical surface 52; B, the diameter of the nozzle ball 16 at edge 55; C, the diameter of the aperture 36; and D, the diameter of the nozzle ball 16 at the spherical surface 52. The various dimensions are as follows:

A=0.9751"
B=0.805"
C=0.770"
D=1.126"
E=30°
F=16.85°

It will be understood that no limitation of the scope of the invention is hereby intended. While the inventions is being disclosed and described with references to a limited number of embodiments, those skilled in the art will appreciate that the various modifications, variations and additions to the nozzle may be made, and is therefore intended in the following claims to cover each such variation, addition and modification as falls within the true spirit and scope of the invention. Such alteration and further modifications in the illustrated device, in such applications of the principles of the invention as is illustrated herein as with normally occurred to one skilled in the art to which the inventions relates are considered as included in the invention.

I claim:

1. A nozzle ball for use in a spray nozzle, the nozzle ball comprising: a main body having a substantially spherical surface; a spray outlet in the nozzle ball; an inlet aperture in the nozzle ball; a cavity in the nozzle ball providing flow communication between the inlet aperture and the spray outlet; and a sealing lip on the main body, the sealing lip extending around the inlet aperture and extending radially outwardly beyond the spherical surface, whereby in use, when mounted in a socket having a spherical surface complementary to the spherical surface of the main body, the sealing lip can be pressed against the spherical surface of the socket to form a seal.

2. A nozzle ball as claimed in claim 1, which includes an axis, extending through the center of the spherical surface of the main body, wherein the spray outlet and the aperture are co-axial with the axis and wherein the sealing lip includes a circular sealing edge coaxial with the axis.

3. A nozzle ball as claimed in claim 2, wherein the sealing lip includes an outer surface tangential with the spherical surface of the nozzle ball.

4. A nozzle ball as claimed in claim 3 wherein, the sealing lip includes a conical outer surface, which is tangential with the spherical surface of the nozzle ball.

5. A nozzle ball as claimed in claim 4, wherein the sealing lip includes a cylindrical inner surface extending into the cavity and coaxial with the axis.

6. A nozzle ball as claimed in claim 5, wherein the lip includes an annular end surface extending between the inner and outer surfaces of the lip, and wherein the sealing edge is formed between the annular end surface and the outer surface of the lip.

7. A nozzle ball as claimed in claim 6, wherein the conical outer surface of the sealing lip has a cone generating angle of 30°, and an angular extent, measured in a plane including the axis, of approximately 17°.

8. A nozzle ball as claimed in claim 5, which includes a cylindrical post extending coaxially from the main body of the nozzle ball and wherein the spray outlet is provided at a free end of the post.

9. A nozzle ball as claimed in claim 8, which is integrally moulded from a plastic material.

10. A nozzle ball as claimed in claim 9, wherein the nozzle ball is integrally moulded from glass reinforced polypropylene.

11. A spray nozzle assembly comprising:

a nozzle ball which comprises a main body having a substantially spherical surface, a spray outlet in the nozzle ball, an inlet aperture in the main body, a cavity in the nozzle ball providing flow communication between the inlet aperture and the spray outlet, and a sealing lip on the main body, the sealing lip extending around the aperture and extending radially outwardly beyond the spherical surface;

a nozzle body defining a part-spherical socket, which is open at one end of the nozzle body, and a passageway extending from the socket to the other end of the nozzle body, the socket including a part-spherical surface complementary to the spherical surface of the nozzle ball, wherein the nozzle body includes a first coupling formation; and locking means including a second coupling formation, adapted to engage the first coupling formation, so as to secure the nozzle ball within the socket and to press the nozzle ball into the nozzle socket, whereby the sealing lip of the nozzle ball is pressed against the socket to form a seal.

12. A spray nozzle assembly as claimed in claim 11, which includes an axis, extending through the center of the spherical surface of the main body, wherein the spray outlet and the aperture are co-axial with the axis and wherein the sealing lip comprises a circular sealing edge coaxial with the axis.

13. A nozzle as claimed in claim 12, wherein, the sealing lip includes a conical outer surface, which is tangential with the spherical surface of the nozzle ball.

14. A spray nozzle assembly as claimed in claim 13, wherein the sealing lip includes a cylindrical inner surface extending into the cavity and coaxial with the axis, wherein the lip includes an annular end surface extending between the inner and outer surfaces of the lip, and wherein the sealing edge is formed between the annular end surface and the outer surface of the lip.

15. A spray nozzle assembly as claimed in claim 14, wherein the nozzle ball, the nozzle body and the locking means are integrally moulded from a plastic material.

16. A spray nozzle assembly as claimed in claim 15, wherein the nozzle ball, the nozzle body and the locking means are integrally moulded from glass reinforced polypropylene.

17. A spray nozzle assembly as claimed in claim 16, wherein the locking means comprises a locking collar and the first and second coupling formations comprise complementary screw threads.

18. A fluid connection device, for providing fluid communication between two fluid conduits, the device comprising:

a first member defining a socket open at one end of the fluid member, and a connection port extending from the socket and open at the other end of the fluid member, the socket defining a part-spherical surface;

a second fluid member including a main body having a spherical outer surface complementary to the spherical surface of the socket, an aperture in the socket, a second communication port and a cavity within the second member extending between the second communication port and the aperture, and a sealing lip around the aperture and extending radially outwardly beyond the spherical surface of the second fluid member; and engagement means, engagable with the first fluid member, for maintaining the second fluid member within the socket and for pressing the sealing lip of the second fluid member against the socket to form a seal.

* * * * *